United States Patent [19]

Mercer et al.

[11] 4,320,858

[45] Mar. 23, 1982

[54] HOT MELT ADHESIVE APPLICATOR

[75] Inventors: Jeffrey L. Mercer, Gallatin; James B. White, Nashville, both of Tenn.

[73] Assignee: Mercer Corporation, Hendersonville, Tenn.

[21] Appl. No.: 130,135

[22] Filed: Mar. 13, 1980

[51] Int. Cl.[3] ..... B67D 5/62

[52] U.S. Cl. ..... 222/146 HE; 222/504

[58] Field of Search ..... 222/504, 146 HE, 146 HS, 222/309; 401/2, 3, 187; 219/301

[56] References Cited

U.S. PATENT DOCUMENTS 3,690,518 9/1972 Baker et al. ..... 222/504

4,099,653 7/1978 Scholl ..... 222/146 HE

*Primary Examiner*—Stanley H. Tollberg

*Attorney, Agent, or Firm*—Harrington A. Lackey

[57] ABSTRACT

A hot melt adhesive applicator including a dispenser head or block having a liquid chamber in one end portion and a cartridge cavity in the opposite end portion communicating through a stem passage and further comprising a replacable needle valve cartridge including a valve body containing a pneumatically actuated valve having a valve stem depending below the valve cartridge body through the stem passage and the liquid chamber for opening and closing the orifice in the nozzle assembly at one end of the liquid chamber. The dispenser head or block is modular and adapted to receive one or more valve cartridges and is provided with a liquid passage communicating with the liquid chamber and a source of liquid under pressure, and an air passage communicating with the air chamber in the cartridge within the cartridge cavity and also communicating with a source of compressed air. The dispenser head is preferably heated in order to maintain the hot melt adhesive in the liquid chamber in a liquid condition.

8 Claims, 4 Drawing Figures

HOT MELT ADHESIVE APPLICATOR

BACKGROUND OF THE INVENTION

This invention relates to a fluid dispenser, and more particularly to a hot melt adhesive applicator.

Hot melt adhesive applicators including pneumatically actuated needle valves in modular systems for dispensing or discharging small amounts of hot melt adhesive, are well known in the art, as exemplified by the following U.S. Pat. Nos.:

3,094,254 Cullen et al—June 18, 1963
3,332,580 Spencer et al—July 25, 1967
3,332,581 Estabrooks—July 25, 1967
3,348,520 Lockwood—Oct. 24, 1967
Re. 27,865 Baker et al—Jan. 1, 1974
3,690,518 Baker et al—Sept. 12, 1972
3,840,158 Baker et al—Oct. 8, 1974
4,066,188 Scholl et al—Jan. 3, 1978

The patents to Cullen et al, Estabrooks, and Scholl et al disclose pneumatically actuated needle valves which are mounted in the body structure of the manifold or dispenser head. The disassembly of the elements is quite complex if it is desired to remove, for replacement or repair, the needle valve or the valve actuator.

Although all three of the above Baker patents disclose needle valve cartridges for insertion upon, or into corresponding openings within, a service block or module, nevertheless such cartridges include a body incorporating not only the valve, valve actuator and air chamber, but also a liquid adhesive chamber. Such cartridges contain more elements than necessary for replacement, and further require more seals than necessary to prevent the leakage of air and liquid adhesive.

SUMMARY OF THE INVENTION

It is an object of this invention to provide a hot melt adhesive applicator including a fixed modular dispensing head and a readily removable valve cartridge.

The dispenser head made in accordance with this invention not only includes the air and liquid passages for attachment to corresponding flexible hoses for supplying, respectively, compressed air and compressed hot melt adhesive, but also incorporates as a part of the dispenser head, the hot melt liquid adhesive chamber and the nozzle having a discharge orifice mounted in the opening from the liquid chamber.

Thus, the cartridge assembly, including the needle valve and the valve actuator has a body which incorporates only the housing for the valve piston, spring and air chamber, but which does not incorporate the nozzle or the liquid chamber, which is formed in the lower portion of the dispensing head.

Therefore, the replacable needle valve cartridge incorporates fewer parts than prior art replacable cartridges, and is accordingly less expensive.

Furthermore, by providing the external mounting threads on the smaller portion of the cartridge body, cartridge cavities of smaller diameter may be formed in the dispensing head or block to permit more cartridges to be mounted on closer centers.

The cartridge also includes an easily adjustable external stop screw for engaging the valve piston in various axial positions in order to vary the stem travel of the needle valve.

An O-ring is mounted in rolling engagement with the valve stem in the air chamber to seal the air chamber from the liquid chamber. This rolling engagement of the O-ring, for the limited axial travel of the valve stem, provides longer life for the O-ring seal, an important factor for a needle valve that is in continuous use for the discharge of hot melt adhesives for long production times.

DESCRIPTION OF THE PREFERRED EMBODIMENTS

Figures 1, 2, 3, 4:
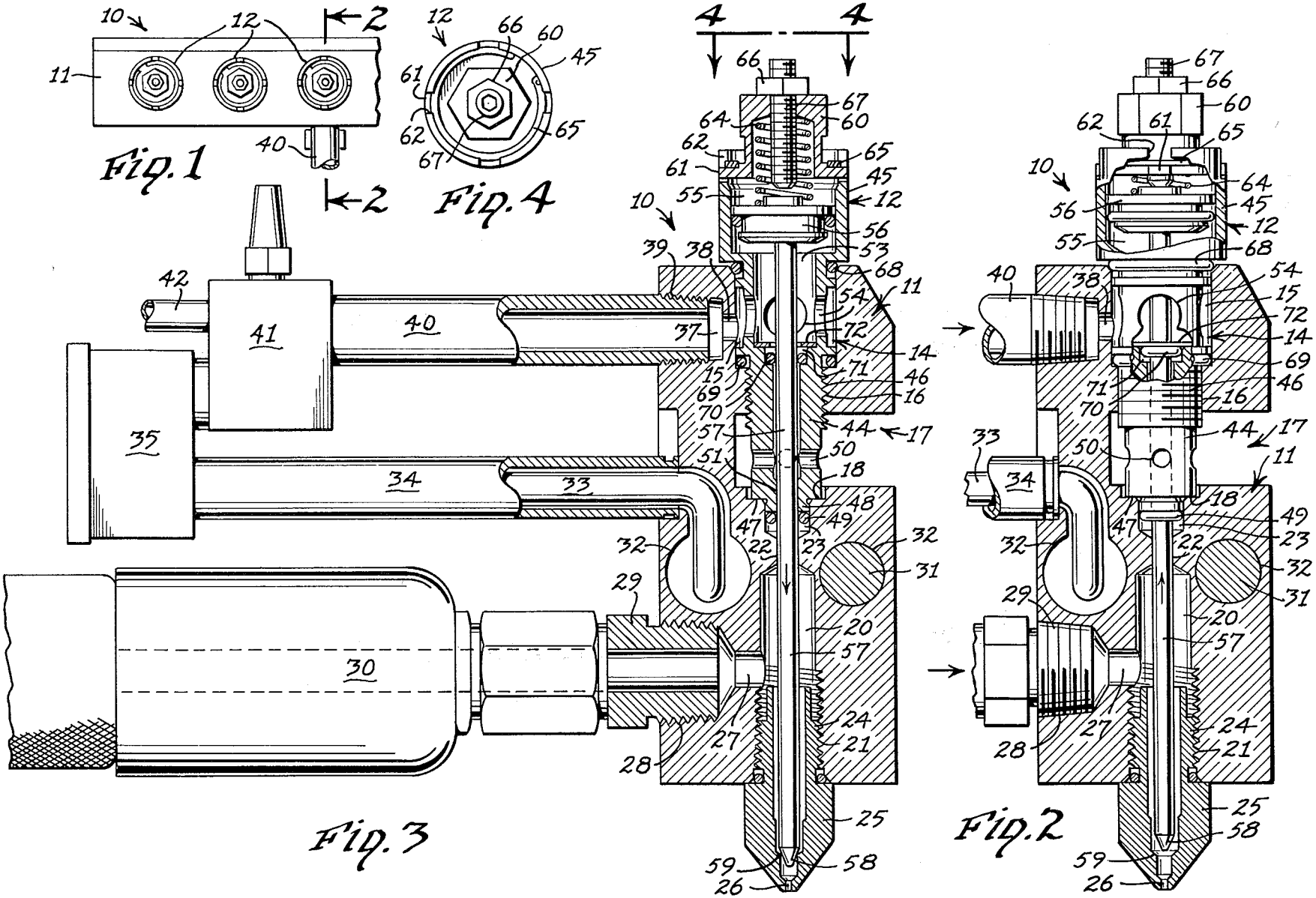
FIG. 1 is a fragmentary top plan view of a modular applicator made in accordance with this invention.
FIG. 2 is an enlarged, fragmentary section taken along the line 2—2 of FIG. 1, with the cartridge disclosed in side elevation, with portions broken away, and with the needle valve in its open position.
FIG. 3 is a view similar to FIG. 2, with the cartridge disclosed in section and with the service conduits attached to the head.
FIG. 4 is a top plan view taken along the line 4—4 of FIG. 3.

Referring now to the drawings in more detail, the hot melt adhesive applicator apparatus 10 made in accordance with this invention includes two readily separable parts or modules, namely a dispenser head or block 11 and a valve cartridge 12.

The upper or first end portion of the head 11 includes a cartridge cavity 14, including an upper air cavity 15, an internally threaded opening 16, a vent recess 17 and a cartridge seat 18.

Formed in the lower or second end portion of the head 11 is an elongated, generally cylindrically-shaped, liquid chamber 20 opening downward through the bottom end of the head 11, having a lower internally threaded wall portion 21.

The upper end of the liquid chamber 20 opens into a stem passage 22 which in turn communicates with a seal chamber 23 opening into the cartridge seat 18.

Adapted to be threadedly secured within the internally threaded wall portion 21 in the lower part of the liquid chamber 20, is the externally threaded stem 24 of a nozzle 25 having a discharge orifice 26 therein.

A transversely disposed liquid passage 27 projects laterally from, and in fluid communication with, the liquid chamber 20, and has an internally threaded portion 28 to receive the externally threaded coupling 29 of a supply hose 30 through which the liquid hot melt adhesive is supplied under pressure, from a conventional source, not shown.

Although the hot melt adhesive is supplied to the liquid chamber 20 within the dispenser block 11 in a hot molten condition, nevertheless the block 11 is also heated by electrical heater cores 31 contained in the heater bores 32 of the lower portion of the head 11. The heater cores 31 are supplied with electricity through the electrical cable 33 carried in the electrical conduit 34 connected to an electrical wire junction box 35. The electrical junction box 35 is in turn connected through other electrical conduits, not shown, to a source of electrical voltage, not shown.

An air passage 37 formed in the upper portion of the head 11 communicates through an air port 38 with the air cavity 15. The outer end portion 39 of the air passage 37 is internally threaded to receive the externally threaded portion of an air conduit 40, through which compressed air is supplied from a solenoid air valve 41.

The air valve 41 is connected to a source of compressed air, not shown, through the air inlet conduit 42.

The valve cartridge 12 comprises a lower body portion 44 and an upper body portion 45 of larger cross-sectional dimension than the lower body portion 44.

The lower body portion 44 has an externally threaded portion 46 for threadedly engaging the internally threaded opening 16 of the header 11 when the cartridge 12 is assembled in its operative position within the head 11.

The bottom end 47 of the lower body portion 44 engages the seat 18 in operative position and is provided with a depending annular shoulder 48 of substantially smaller diameter for fitting within the seal chamber 23 and securing therein a sealing O-ring 49.

The lower body portion 44 is provided with radially extending weep holes 50 opening into the vent recess 17. The purpose of the weep holes 50 is to discharge any liquid adhesive material which may inadvertently seep upward through the step passage 22, past the sealing O-ring 49 and through the coaxial stem bore 51 intercepting the weep holes 50.

The upper part of the lower body portion 44 defines an air chamber 53 having radial inlet ports 54 communicating with the air cavity 15.

The upper open end of the air chamber 53 communicates with the piston chamber 55 formed in the larger body portion 45 and receiving for reciprocable movement the annular piston 56. The piston 56 is integral with the upper end of the valve stem 57, the lower extremity of which terminates in a conical valve tip 58 adapted to fit within the valve seat 59 of the nozzle 25, in closed position, as disclosed in FIG. 3.

The piston chamber 55 has its upper end closed by an end cap 60 having radially projecting lugs 61 at the bottom thereof received in corresponding slots 62 in the upper body portion 45. The end cap 60 compresses a coil spring 64 down against the piston 56 in order to bias the valve stem 57 downward causing the valve tip 58 to seat against the valve seat 59 of the nozzle 25, in closed position (FIG. 3).

The end cap 60 is held in its operative position by a snap ring 65.

When the solenoid air valve 41 is energized to discharge compressed air through the conduit 40, air passage 37, air port 38, air cavity 15, air inlets 54 and into the air chamber 33, the piston 56 is forced upward to compress the spring 64 and raise the valve stem 57 and valve tip 58 from the valve seat 59 and thereby open the orifice 26, to discharge hot melt adhesive liquid through the nozzle 25 from the liquid chamber 20.

The upper limit of the valve stem 57 may be regulated by the adjustable stem travel screw 67 threaded through a corresponding opening in the top wall of the end cap 60. The upward travel of the valve stem 57 is limited when the piston 56 engages the bottom end of the stem travel adjustment screw 67, as illustrated in FIG. 2. If it is desired to discharge less adhesive liquid between the valve tip 58 and the valve seat 59, the stem travel screw 67 may be turned to lower the screw 67 and thereby engage the piston 56 at a lower height. The stem travel screw 67 may be held in its adjusted position by the lock nut 66.

It will be noted in the drawings that the lower end of the cartridge body or valve body 47 and its shoulder 48 are located above the stem passage 22, so that no part of the valve body 12 extends into the lower portion of the head 11. Furthermore, no portion of the valve body 12 forms a liquid chamber, since the liquid chamber 20 is formed entirely within the body of the head 12.

The only portion of the cartridge 12 within the lower portion of the head 11 is the valve stem 57 which extends through, and is adapted to reciprocate within, the stem passage 22 the liquid chamber 20 and the nozzle 25.

Since the lower body portion 44, which is of smaller diameter than the upper body portion 45, is provided with external threads 46 for engaging the internal threads 16 of the head 11, the larger upper body portion 45 may project entirely above the head 11. Thus, the entire cartridge cavity 14 may be smaller than the larger upper body portion 45, permitting a plurality of smaller cartridge cavities 14 to be formed within the head 11 on closer centers.

Because the liquid chamber 20 is formed within the lower portion of the head 11, no seals are required between the chamber 20 and the hose 30.

The only seals required between the external surface of the valve body portion 44 and the head 11 are the O-rings 68 and 69 above and below, respectively, the inlet portions 54. Of course, the rolling O-ring 49 is provided around the stem 57 in the sealing chamber 23.

Another O-ring 70 is fitted snugly around the valve stem 57 within the sealing recess 71 in the bottom portion of the air chamber 53, and is held in that sealing recess 71 by means of a retainer ring 72.

Since the extent of the valve stem travel is in the order of 1/32nd of an inch, the O-rings 70 and 49 are permitted to roll in their respective recesses 23 and 71 as the stem reciprocates, with a minimum of frictional movement, thereby extending the life of the respective O-rings 49 and 70.

It is therefore seen that a modular hot melt adhesive applicator apparatus 10 has been provided, including a readily removable valve cartridge 12 which may be easily replaced or repaired. This valve cartridge 12 includes a minimum of the operative parts which require the most repair and maintenance. Thus the cartridge 12 eliminates much unnecessary structure which normally would add to the expense and weight of the cartridge for replacement.

Moreover, it is seen that a cartridge 12 has been provided which requires a minimum of sealing between the body of the cartridge and the corresponding cavities within the head 11.

What is claimed is:

1. An applicator apparatus for dispensing hot melt adhesive comprising:

(a) a dispenser head having first and second opposed end portions, (b) a cartridge cavity within said head and opening through said first end portion, (c) a liquid chamber formed within, and structurally a part of, said head, and having an opening through said second end portion, (d) nozzle means having an orifice mounted in said opening, (e) a stem passage formed within, and structurally a part of, said head, and extending between said cartridge cavity and said liquid chamber, (f) a liquid passage in said head in fluid communication with said liquid chamber and adapted to communicate with a source of liquid, (g) an air passage in said head in fluid communication with said cartridge cavity and adapted to communicate with a source of compressed air, (h) a modular valve cartridge removably mountable in said cartridge cavity in operative position, (i) said cartridge comprising a valve body and a valve stem operable in said valve body, (j) said valve body having first and second end portions, said second end portion terminating on the opposite side of said stem passage from said liquid chamber, in operative position, (k) said valve stem projecting from said second end portion of said valve body, through said stem passage and said liquid chamber into said nozzle means for opening and closing said orifice, in said operative position, (l) said stem passage being just large enough in cross-section to receive only said valve stem for coaxial reciprocable movement, (m) valve actuator means within said valve body for controlling said valve stem to open said orifice in response to an increase in air pressure, and (n) an air port within said valve body in fluid communication between said air passage and said valve actuator means, in said operative position.

2. The invention according to claim 1 in which said valve body comprises an air chamber within said cartridge cavity in operative position, and an actuator chamber in said first end portion receiving said valve actuator means, said actuator chamber being of greater cross-section than said cartridge cavity and outside said dispenser head in operative position, and means securing said valve body in operative position in said dispenser head.

3. The invention according to claim 2 in which said securing means comprises external threads on said valve body and mating internal threads in said cartridge cavity for threadedly engaging said external threads.

4. The invention according to claim 1 in which said valve body comprises an air chamber in communication with said air port and a stem bore extending through said valve body in communication with said air chamber and extending below said air port for reciprocably receiving said valve stem, a sealing ring surrounding said valve stem between the terminal end of said valve body and said stem passage and adjacent the corresponding end of said stem bore, said sealing ring permitting the reciprocable travel of said valve stem therethrough while blocking the passage of liquid from said liquid chamber into said stem bore.

5. The invention according to claim 4 in which said sealing ring is an O-ring in rollable engagement with said valve stem.

6. The invention according to claim 5 comprising a second O-ring surrounding and in rolling engagement with said valve stem in said air chamber and adjacent said stem bore to permit the reciprocable travel of said valve stem therethrough while blocking the passage of air from said air chamber into

7. The invention according to claim 1 in which said valve actuator means comprises a piston on said valve stem and on the opposite side of said air port from said liquid chamber, spring means on the opposite side of said piston from said air port, an adjustment stop screw in said valve body on the opposite side of said piston from said air port, and adjustable toward and away from said piston for engagement with said piston in various adjustable positions to determine the axial travel of said valve stem.

8. The invention according to claim 1 further comprising means for heating said dispenser head in thermal transfer relationship with said liquid chamber.

* * * * *